US009718659B2

(12) United States Patent
Huang

(10) Patent No.: US 9,718,659 B2
(45) Date of Patent: Aug. 1, 2017

(54) LIFTING DEVICE

(71) Applicant: Ming-Hsien Huang, New Taipei (TW)

(72) Inventor: Ming-Hsien Huang, New Taipei (TW)

( * ) Notice: Subject to any disclaimer, the term of this patent is extended or adjusted under 35 U.S.C. 154(b) by 333 days.

(21) Appl. No.: 14/714,356

(22) Filed: May 18, 2015

(65) Prior Publication Data

US 2016/0236920 A1 Aug. 18, 2016

(30) Foreign Application Priority Data

Feb. 16, 2015 (TW) ..... 104202636 U

(51) Int. Cl.
*B66F 11/04* (2006.01)
*B66F 9/06* (2006.01)

(52) U.S. Cl.
CPC ..... *B66F 9/06* (2013.01)

(58) Field of Classification Search
CPC ... B66D 1/40; B66D 1/60; B66D 3/04; B66D 3/06; B66F 11/04
See application file for complete search history.

(56) References Cited

U.S. PATENT DOCUMENTS 2,471,998 A * 5/1949 Berggren ..... A61B 6/447 192/17 R
3,269,035 A * 8/1966 Bong ..... A47B 97/06 434/420
3,575,368 A * 4/1971 Thomas ..... A61B 6/447 248/572
4,605,189 A * 8/1986 Bruneau ..... A47B 27/06 108/146
4,760,622 A * 8/1988 Rohrman ..... E05D 13/1207 16/196
4,914,780 A * 4/1990 Rogers ..... E05D 13/123 16/16
4,953,748 A * 9/1990 Wheelock ..... G07D 11/0012 221/198
5,400,721 A * 3/1995 Greene ..... A47B 9/02 108/147
6,434,851 B1 * 8/2002 Nishina ..... F02K 1/763 33/559
8,286,927 B2 10/2012 Sweere et al.
8,925,154 B2 * 1/2015 Ergun ..... H01H 85/24 16/342
9,267,639 B2 * 2/2016 Sweere ..... F16M 11/30
2006/0145036 A1 * 7/2006 Jones ..... A47B 9/00 248/188.5

(Continued)

*Primary Examiner* — Emmanuel M Marcelo
(74) *Attorney, Agent, or Firm* — Jianq Chyun IP Office

(57) ABSTRACT

A lifting device including a body, a sliding member, a pulley, a worm, an elastic member and a connecting member is provided. The sliding member is used to set an object and stays at any position between two positions. The pulley has a fist groove. A curvature radius of the first groove is a constant value. The worm has a second groove. A curvature radius of the second groove is a non-constant value. The elastic member is disposed in the body. When the sliding member is slid between the two positions, the pulley and the worm are rotated in at least one circle. A sum which a first torque generated by a gravity of the object and the sliding member with the curvature radius of the first groove and a second torque generated by a force of the elastic member with the curvature radius of the second groove is zero.

11 Claims, 12 Drawing Sheets

(56) References Cited

U.S. PATENT DOCUMENTS

| | | | | |
|---|---|---|---|---|
| 2008/0099637 | A1* | 5/2008 | Pai | F16M 11/30<br>248/157 |
| 2009/0189048 | A1* | 7/2009 | Gan | F16M 11/24<br>248/422 |
| 2013/0256489 | A1* | 10/2013 | Ergun | F16M 11/10<br>248/297.11 |

* cited by examiner

LIFTING DEVICE

CROSS-REFERENCE TO RELATED APPLICATION

This application claims the priority benefit of Taiwan application serial no. 104202636 filed on Feb. 16, 2015. The entirety of the above-mentioned patent application is hereby incorporated by reference herein and made a part of this specification.

BACKGROUND OF THE INVENTION

1. Field of the Invention

The invention generally relates to a lifting device, and more particularly, to a lifting device enabling an object to stop at any position.

2. Description of Related Art

US Patent Publication No. U.S. Pat. No. 8,286,927 discloses a lifting device, which uses a plurality of cables to respectively connect between a pulley, a cam and a spring so as to perform an lifting adjustment of a supporting frame, and achieves a torque equilibrium through forces of the supporting frame and its installation equipment, or a gravity and a force of the spring, so as to enable the equipment can stay at any position. In addition, during a process of lifting adjustment for the supporting frame, the cam can be rotated for winding or releasing the cables on the cam, so that the supporting frame can have an adjustable stroke. However, as being limited by the shape of the cam, only the prior ¾ circle of the cam that can produce an effective torque equilibrium (as shown in FIG. 2 of U.S. Pat. No. 8,286,927), so that an effect of staying at any position can be achieved. If forcing the cam to rotate more than ¾ circle, then the effect of staying at any position would unable to be achieved; and if the rotation of the cam is being limited within approximately ¾ circle, then a length of the cable winding on the cam would be limited, and thus the adjustment stroke of the supporting frame would be reduced.

SUMMARY OF THE INVENTION

The invention is directed to a lifting device, which has a larger adjustment stroke.

The lifting device of the invention is used to carry an object and includes a body, a sliding member, a pulley, a worm, an elastic member and a connecting member. The sliding member is slidably disposed in on the body, is used to set the object, and can stay at any position between a first position and a second position. The pulley is pivoted within the body and has at least one first groove surrounding a circumference of the pulley, wherein a curvature radius of the first groove is a constant value. The worm and the pulley are coaxial. The worm has a second groove surrounding a circumference of the worm, wherein a curvature radius of the second groove gradually changes. The elastic member is disposed in the body and has a first end and a second end opposite to each other. The connecting member has a first end portion connected with the second end of the elastic member and a second end portion connected with the sliding member, and is wound within the first groove and the second groove. When the sliding member slides from the first position to the second position, or slides from the second position to the first position, the worm and the pulley can rotate at least one circle. Gravity of the object and the sliding member act in concert with the curvature radius of the first groove to generate a first torque. The elastic member is elastically deformed and correspondingly generates a force, and the force acts in concert with the curvature radius of the second groove to generate a second torque. A sum of the first torque and the second torque is zero.

In one embodiment of the invention, when the sliding member is located at the first position, a length of a portion of the connecting member winding within the first groove is greater than a length of a portion of the connecting member winding within the second groove. When the sliding member is located at the second position, a length of a portion of the connecting member winding within the first groove is smaller than a length of a portion of the connecting member winding within the second groove.

In one embodiment of the invention, the curvature radius of the second groove gradually decreases from a junction between the first groove and the second groove.

In one embodiment of the invention, the lifting device further includes a fine adjusting module disposed on the body. The fine adjusting module includes a bolt, a position limiting member and a fixed pulley. The bolt is rotatably disposed on the body. The position limiting member is disposed within the body and screwed to the bolt. The fixed pulley is pivotally connected with the position limiting member, and the second end portion of the connecting member is connected to the sliding member through the fixed pulley.

In one embodiment of the invention, the lifting device further includes a turning pulley, which is disposed between the worm and the elastic member, for changing an extending direction of the connecting member.

In one embodiment of the invention, the lifting device further includes a stopper module, which is disposed within the body and connected with the sliding member and the second end portion of the connecting member, wherein the stopper module can move back-and-forth between the first position and second position along with the sliding member, and is used to limit the movement of the sliding member when the connecting member breaks.

In one embodiment of the invention, the stopper module includes a fixed plate, a cover, a stopper plate and a torsion spring. The fixed plate is fixed on the sliding member. The cover is disposed on the fixed plate. The stopper plate is disposed between the fixed plate and the cover, wherein the second end portion of the connecting member is sandwiched by the stopper plate and the cover. An end of the stopper plate has a zigzag structure. Two ends of the torsion spring are respectively leaning against the fixed plate and the stopper plate. When the connecting member breaks, the torsion spring drives the stopper plate to rotate, and the zigzag structure is embedded into the body.

In one embodiment of the invention, the lifting device further includes a torque adjusting module, which is connected with the first end of the elastic member.

In one embodiment of the invention, the torque adjusting module includes a screw and an adjusting portion. The screw is rotatably disposed on the body. The adjusting portion is disposed within the body and screwed on the screw, and the first end of the elastic member is hooked on the adjusting portion. When the screw rotates, the adjusting portion moves in relative to the elastic member along the screw so as to adjust a relative position of the first end of the elastic member at the body.

In one embodiment of the invention, the first groove and the second groove are not communicated with each other, and the connecting member is two cables respectively fixed at the first groove and the second groove.

In one embodiment of the invention, the pulley and the worm are integrally formed.

In one embodiment of the invention, the worm further has a position limiting slot, the connecting member further has a bump, the position limiting slot is disposed at the junction between the first groove and the second groove, and the bump is position limited within the position limiting slot.

In view of the above, in the lifting device of the invention, the pulley has the first groove surrounding the circumference thereof and the worm has the second groove surrounding the circumference thereof, wherein the connecting member is wound within the first groove and the second groove. When the sliding member slides between the two positions, the pulley and the worm can rotate at least one circle. As such, a total sliding stroke of the sliding member can be increased, so that the object can have a greater lifting distance. In addition, the curvature radius of the first groove of the pulley is a constant value, and the curvature radius of the second groove of the worm gradually changes (namely, the curvature radius of the second groove is a non-constant value). When the sliding member slides from the first position towards the second position, or slides from the second position towards the first position, a sum of the first torque generated by the gravity of the object and the sliding member in concert with the curvature radius of the first groove and the second torque generated by the force of the elastic member in concert with the curvature radius of the second groove is zero, so that a force equilibrium state can be achieved. Thus, the sliding member can have an effect of staying at any position.

In order to make the aforementioned features and advantages of the present invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
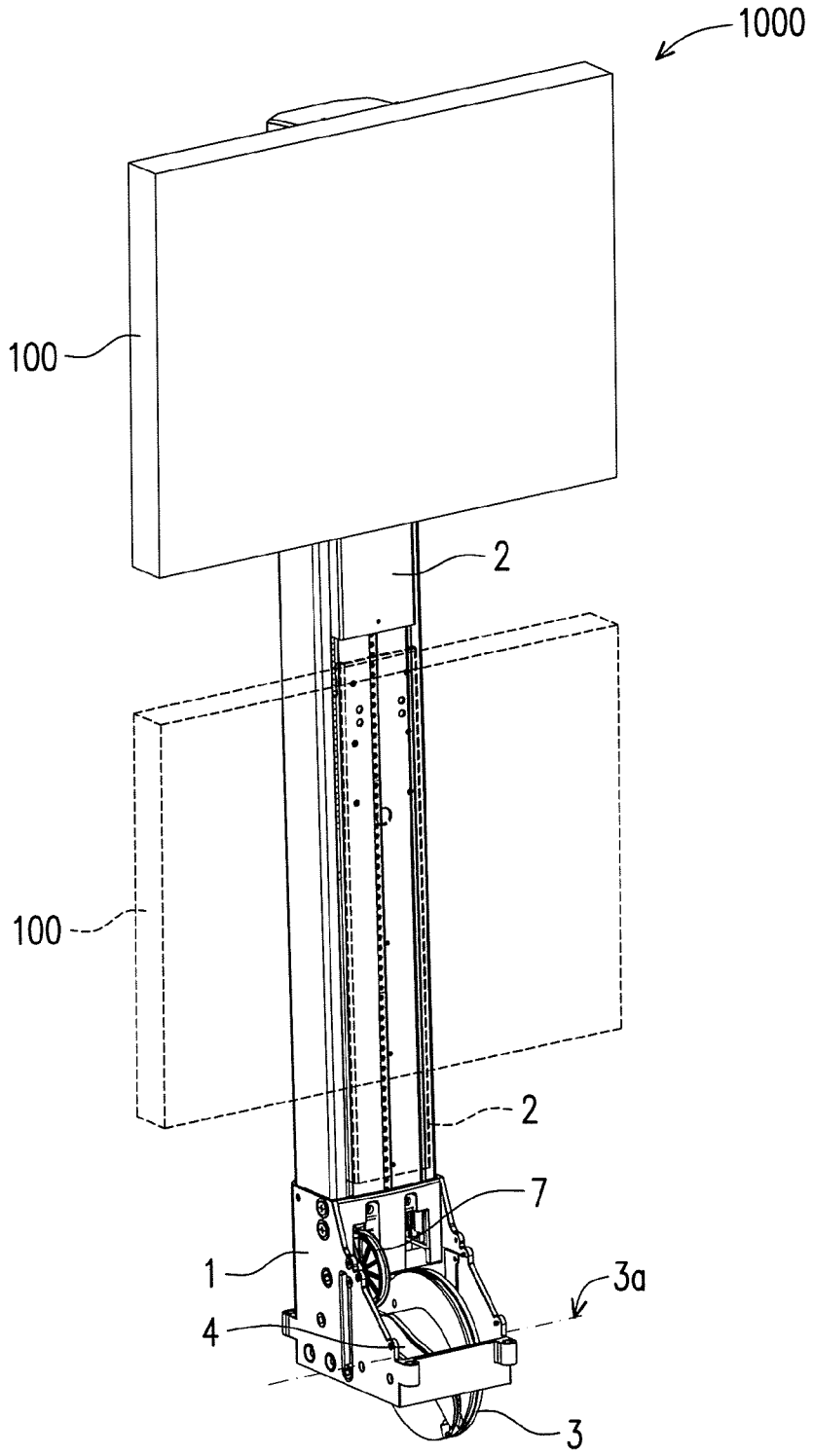
FIG. 1 is a schematic diagram of a lifting device showing the connection with an object located at different positions according to an embodiment of the invention.
Figure 2:
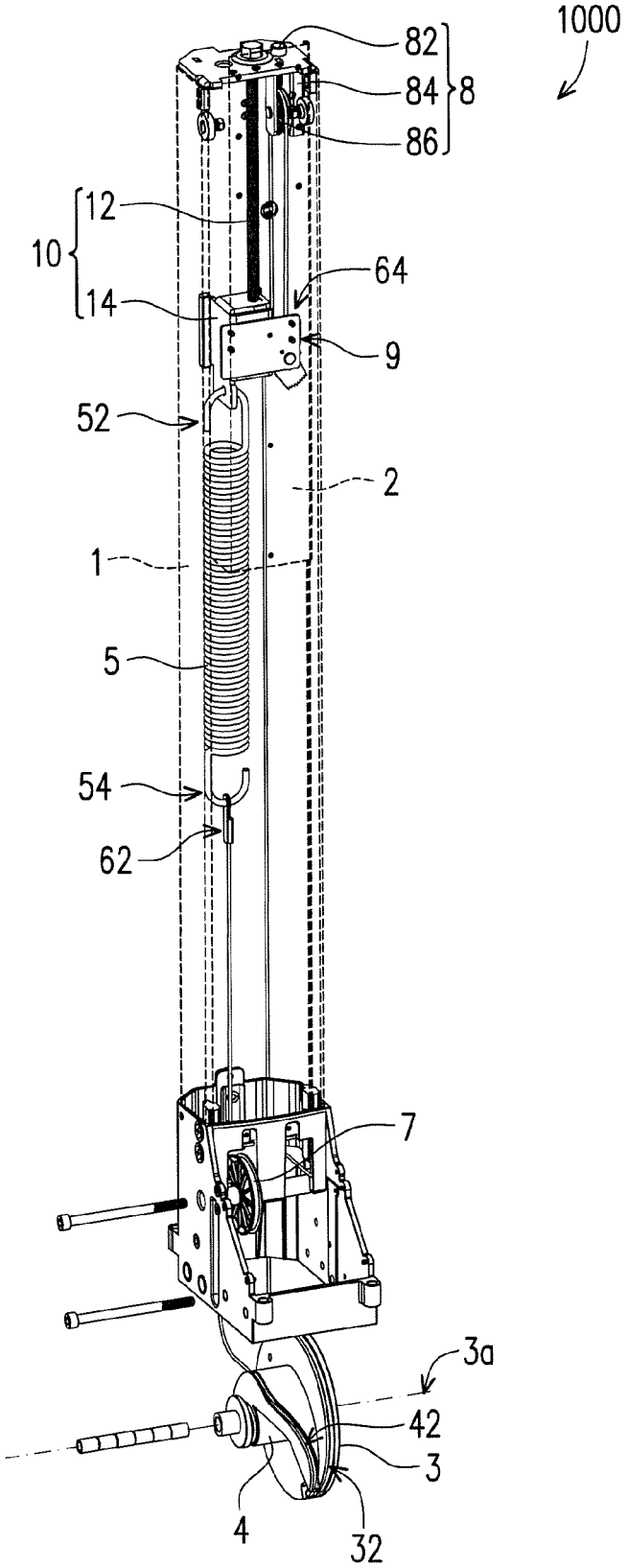
FIG. 2 is an exploded view of the lifting device of FIG. 1.

FIG. 1 is a schematic diagram of a lifting device showing the connection with an object located at different positions according to an embodiment of the invention. FIG. 2 is an exploded view of the lifting device of FIG. 1. Referring to FIG. 1 and FIG. 2, in the present embodiment, a lifting device 1000 is used to carry an object 100, and includes a body 1, a sliding member 2, a pulley 3, a worm 4, an elastic member 5, a connecting member 6, a turning pulley 7 and a fine adjusting module 8.

The sliding member 2 is slidably disposed in on the body 1, and is used to set the object 100 (e.g., a display) and can stay at any position between a first position (e.g., the location of the solid line object 100 and the solid line sliding member 2 shown in FIG. 2) and a second position (e.g., the location of the dashed line object 100 and dashed line sliding member 2 shown in FIG. 2), namely, allowing the object 100 to stay at any position between the first position and the second position. In other words, the first position is the highest location of the object 100, and the second position is the lowest location of the object 100. It is to be explained that, in order to provide a clear view, the body 1 and the sliding member 2 of FIG. 2 are illustrated with dashed-lines, and the object 100 is omitted in FIG. 2.

Figure 3:
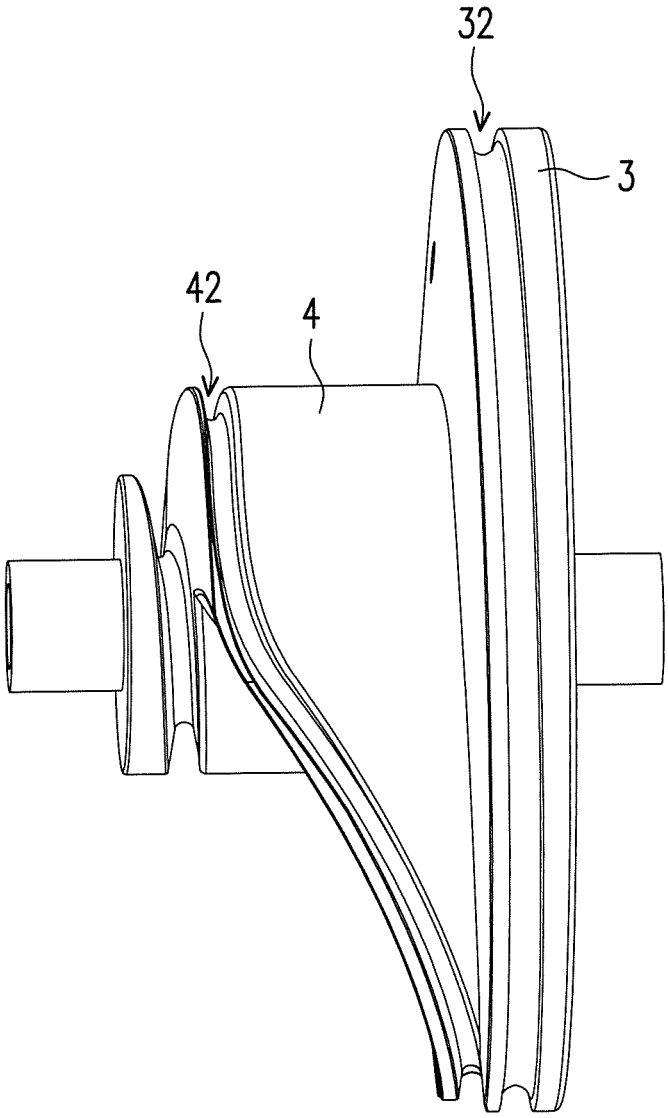
FIG. 3 is a front view of a pulley and a worm of FIG. 2.

FIG. 3 is a front view of the pulley and the worm of FIG. 2. Referring to FIG. 2 and FIG. 3, in the present embodiment, the worm 4 and the pulley 3 are fixedly connected with each other, and are coaxially pivoted within the body 1 via an axle 3*a*. A first groove 32 is formed to surround on a circumferential surface of the pulley 3, and a second groove 42 is formed to surround on a circumferential surface of the worm 4, wherein the first groove 32 is communicated with the second groove 42, a curvature radius 321 (referring to FIG. 6) of the first groove 32 is a constant value, and several curvature radiuses 421, 422, 423, 424, 425 (referring to FIG. 6) of the second groove 42, as compared to the curvature radius 321 of the first groove 32, gradually changes. In other words, the curvature radiuses 421-425 of the second groove 42 are non-constant values and decrease gradually. Meanwhile, the curvature radius of the pulley 3 is greater than an average curvature radius of the worm 4.

In the present embodiment, the elastic member 5 is accommodated in the body 1, and is, for example, a tension spring, but no limited thereto. The elastic member 5 has a first end 52 and a second end 54 opposite to each other. The connecting member 6 has a first end portion 62 and a second end portion 64 opposite to each other, and is wound within the first groove 32 and the second groove 42, wherein the first end portion 62 is connected with the second end 54 of the elastic member 5, and the second end portion 64 is connected with the sliding member 2.

Figure 4A:
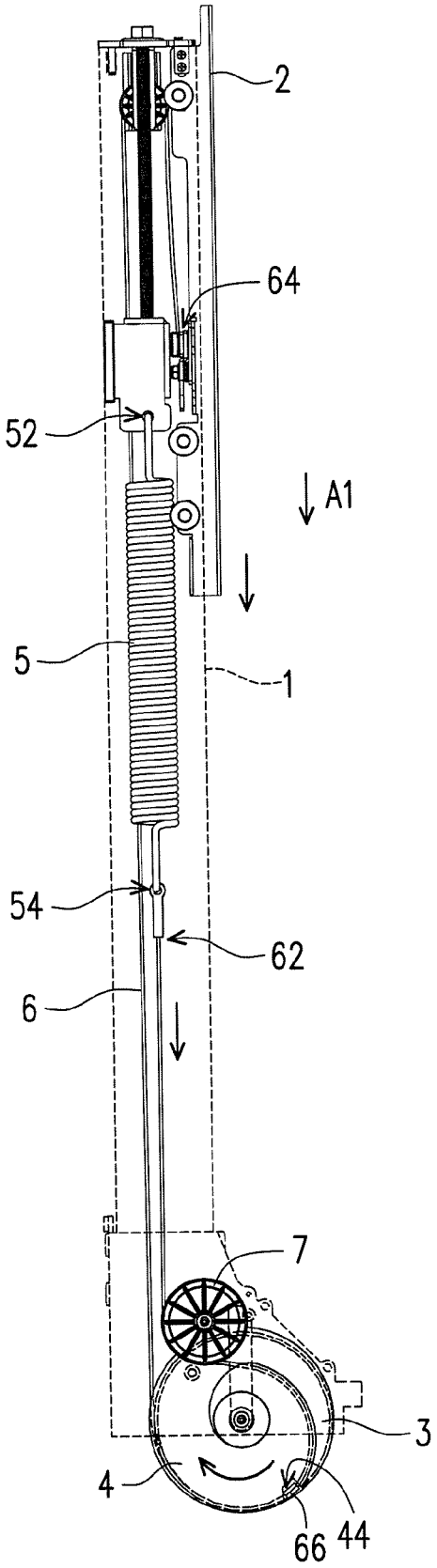
FIG. 4A is a left side view of the lifting device of FIG. 1 at a first position.
Figure 4B:
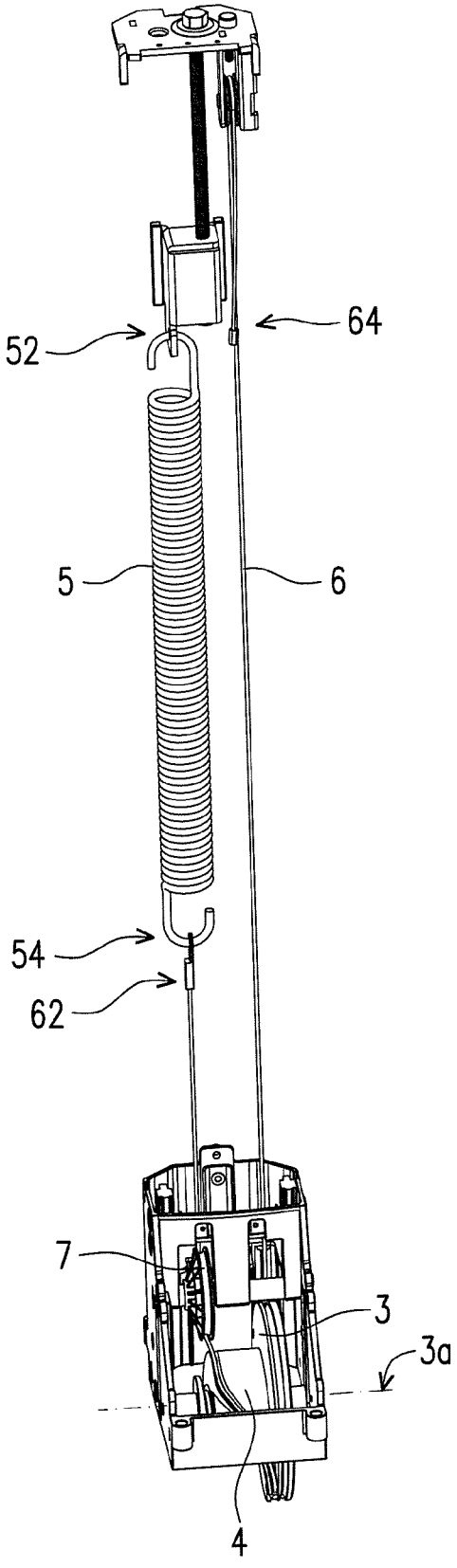
FIG. 4B is an internal perspective view of the lifting device of FIG. 1 at the first position.
Figure 5A:
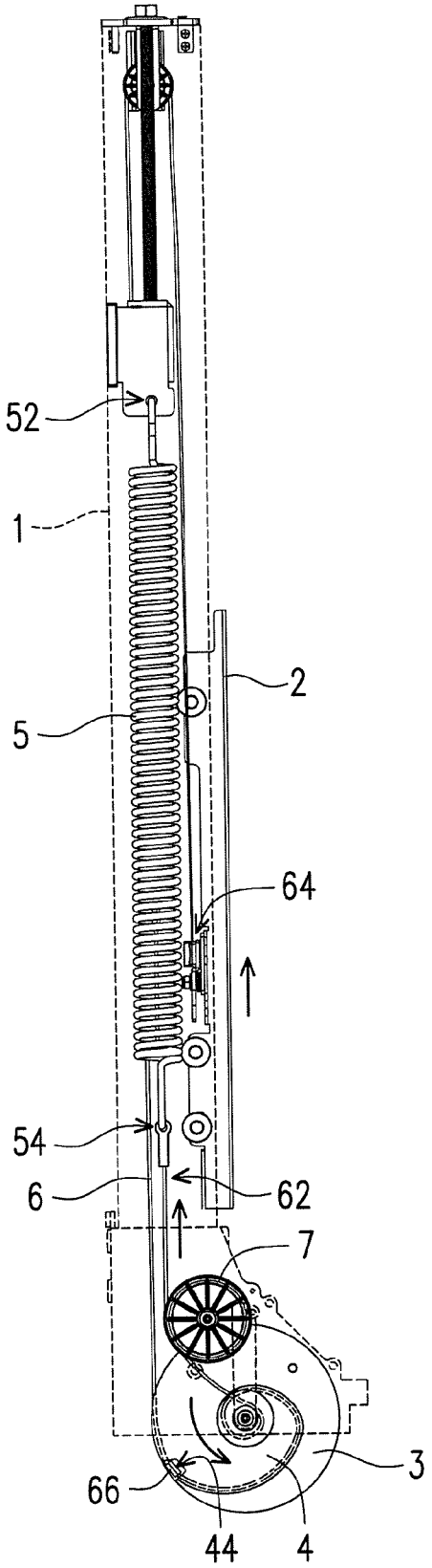
FIG. 5A is a left side view of the lifting device of FIG. 1 at a second position.
Figure 5B:
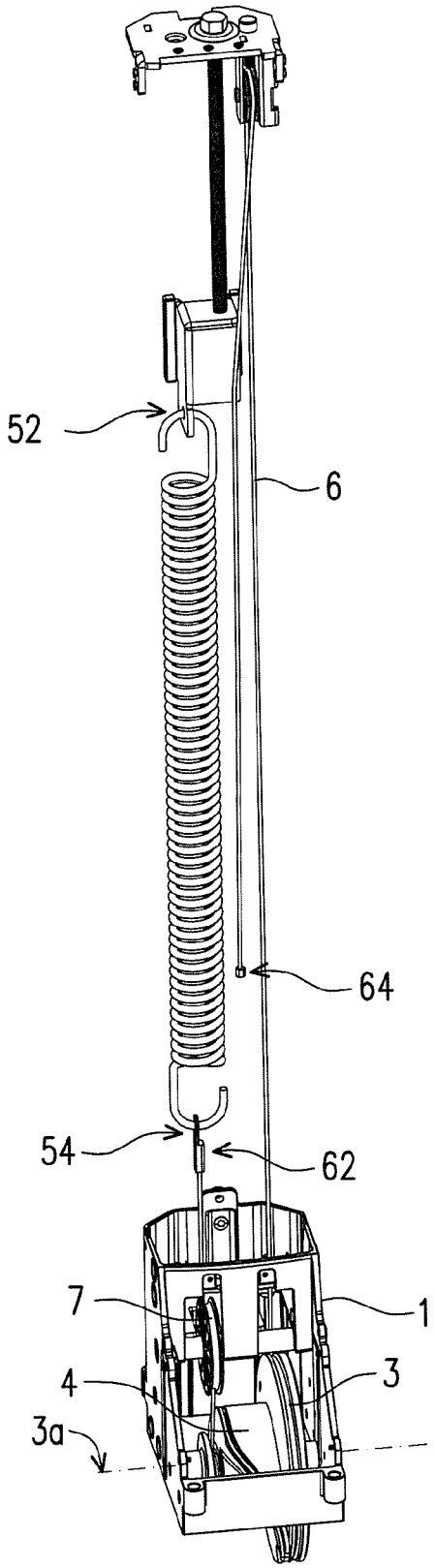
FIG. 5B is an internal perspective view of the lifting device of FIG. 1 at the second position.

FIG. 4A is a left side view of the lifting device of FIG. 1 at the first position. FIG. 4B is an internal perspective view of the lifting device of FIG. 1 at the first position. FIG. 5A is a left side view of the lifting device of FIG. 1 at the second position. FIG. 5B is an internal perspective view of the lifting device of FIG. 1 at the second position. Referring to FIG. 4A and FIG. 4B, when the sliding member 2 is located at the first position, ⅕ (but not limited thereto) of a length of the connecting member 6 is wound within the first groove 32 of the pulley 3 and the second groove 42 of the worm 4, and a length of the portion of the connecting member 6 that is wound within the first groove 32 is far greater than a length of the portion of the connecting member 6 that is wound within the second groove 42. When the sliding member 2 slides along a lifting direction A1 (i.e., the downward direction in FIG. 4A), it drives the second end portion 64 of the connecting member 6 to move downwards. As the sliding member 2 gradually approaches the second position, the connecting member 6 winding within the first groove 32 and the second groove 42 drives the coaxial pulley 3 and worm 4 to rotate clockwisely around the axle 3*a* with a same angle, so that the portion of the connecting member 6 winding within first groove 32 gradually decreases, and the portion of the connecting member 6 winding within the second groove 42 gradually increases, thereby simultaneously driving the first end portion 62 of the connecting member 6 to stretch the elastic member 5, namely, driving the second end 54 of the elastic member 5 to move downwards. After the sliding member 2 slid to the second position, the connecting member 6 within the first groove 32 is almost completely released, such that the length of the portion of the connecting member 6 winding within the first groove 32 is far less the length of the portion of the connecting member 6 winding within the second groove 42.

Referring to FIG. 5A and FIG. 5B, contrarily, when the sliding member 2 slides opposite to the lifting direction A1 (i.e., the upward direction in FIG. 4A), it drives the second end portion 64 of the connecting member 6 to move upwards. As the sliding member 2 gradually approaches the first position, the connecting member 6 winding within the first groove 32 and the second groove 42 drives the coaxial pulley 3 and worm 4 to rotate counterclockwisely around the axle 3*a* with a same angle, so that the portion of the connecting member 6 winding within first groove 32 gradually increases, the portion of the connecting member 6 winding within the second groove 42 gradually decreases, and a degree of stretching the elastic member 5 also gradually decreases, thereby driving the first end portion 62 of the connecting member 6 and the second end 54 of the elastic member 5 to move upwards. After the sliding member 2 slid to the first position, the length of the portion of the connecting member 6 winding within the first groove 32 is far greater than the length of the portion of the connecting member 6 winding within the second groove 42.

Therefore, during the process when the sliding member 2 slides to the first position of the second position, the pulley 3 and the worm 4 can rotate at least one circle, and the lengths of the portions of the connecting member 6 respectively winding within the first groove 32 and second groove 42 can be adjusted. As such, the lifting device 1000 of the present embodiment can produce an adjustment stroke effect larger than the conventional cam designed device, so as to satisfy the operational requirements.

Particularly, in the present embodiment, one circle of the first groove 32 is being used as an example to provide explanation; however, the invention does not limit the number of circles of the first groove 32, such that a user can increase the number of circles of the first groove 32 based on practical needs and with respect to the second groove 42, so as to further enlarge the total sliding stroke of the sliding member 2, and thus the lifting device 1000 can have a better adjustment stroke. Moreover, by increasing the number of circles of the first groove 32 to enlarge the total sliding stroke of the sliding member 2, a diameter of the pulley 3 can be decreased, and thereby reduces a volume occupied by the pulley 3.

In addition, the pulley 3 and the worm 4 of the present embodiment are integrally formed, and thus can avoid errors from being aroused during assembly process and causing risks of which the pulley 3 and the worm 4 are unable to rotate by a same angle. Moreover, the connecting member 6 of the present embodiment is a cable and has a bump 66, and the worm 4 further has a position limiting slot 44, wherein the position limiting slot 44 is disposed at a junction between the first groove 32 and the second groove 42 (referring to FIG. 6). The bump 66 is positionally limited within the position limiting slot 44. Hence, when the sliding member 2 slides, thus driving the second end portion 64 of the connecting member 6 to move upwards or downwards, the portions of the connecting member 6 that are winding within the first groove 32 and the second groove 42 are able to prevent from a situation of slip.

Moreover, in other embodiment, the first groove 32 and the second groove 42 are not communicated with each other, and the connecting member 6 has two cables, in which one of the cables is fixed to the pulley 3 and partly accommodated in the first groove 32 while the other one of the cables is fixed to the worm 4 and partly accommodated in the second groove 42.

Additionally, when the sliding member 2 slides from the first position to the second position, the portion of the connecting member 6 winding on the pulley 3 and the worm 4 gradually decreases. This is because the portion of the connecting member 6 winding within the first groove 32 gradually changes from far greater than to far less than the portion that is wound within the second groove 42, and also because the curvature radius of the pulley 3 is greater than the average curvature radius of the worm 4, such that under the condition of rotating one circle, a length of the portion of connecting member 6 being released from the first groove 32 is smaller than a length of the portion of the connecting member 6 being wound into the second groove 42. As such, the degree of stretching the elastic member 5 can be smaller than the total sliding stroke of the sliding member 2, and thus the service life of the elastic member 5 and the reliability of lifting device 1000 can be increased.

Figure 6:
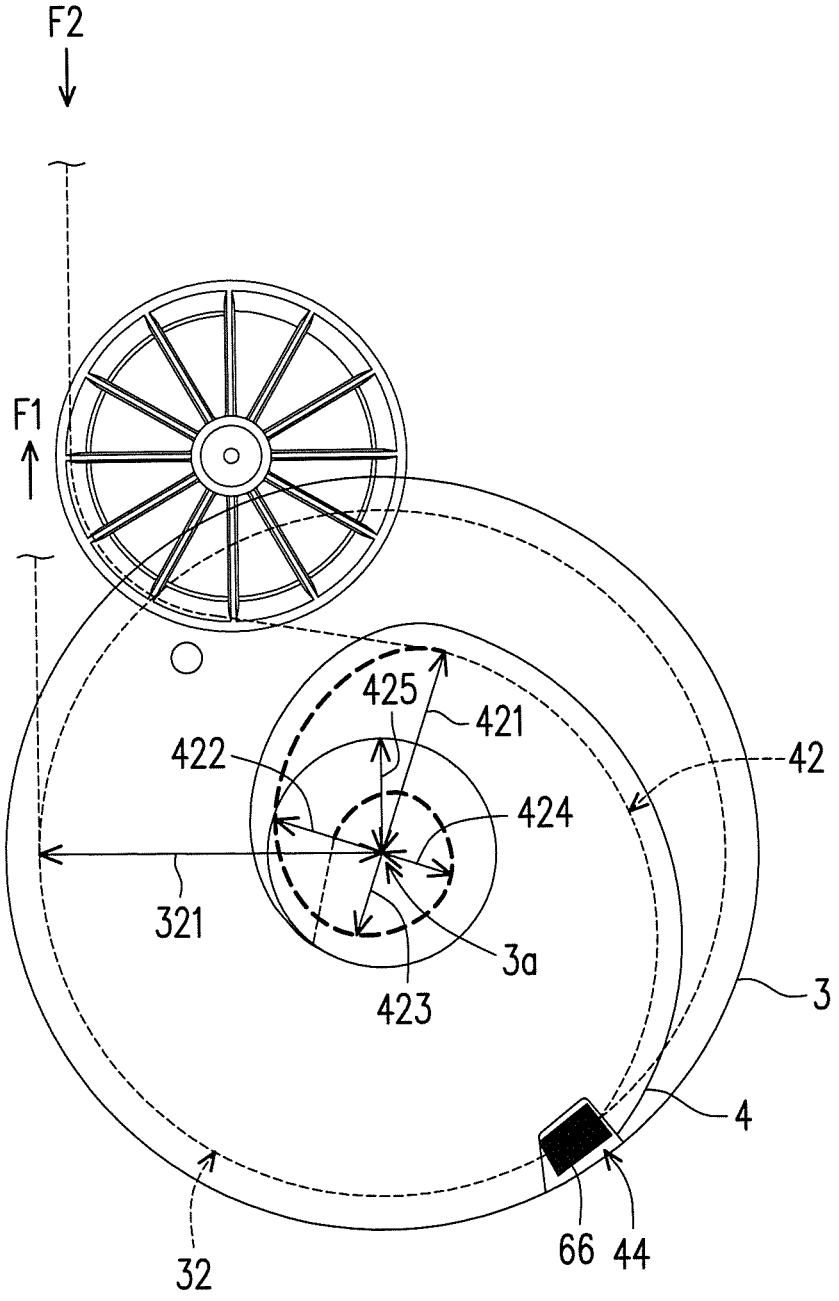
FIG. 6 is a schematic diagram illustrating a torque generated by a connecting member to the pulley and the worm when a sliding member of FIG. 1 is at the first position.

In the following, the principle enabling the sliding member 2 to stay at any position between the first position and the second position will be explained. FIG. 6 is a schematic diagram illustrating a torque generated by the connecting member to the pulley and the worm when the sliding member of FIG. 1 is at the first position. Referring to FIG. 4A, FIG. 5A and FIG. 6, the first groove 32 of the present embodiment has a curvature radius 321, and the curvature radius 321 is a constant value. The second groove 42 has a plurality of curvature radiuses 421, 422, 423, 424 and 425, and the curvature radiuses 421-425 are non-constant values, wherein the curvature radiuses 421-425 of the second groove 42 gradually decrease from the junction between the first groove 32 and the second groove 42, the second groove 42 between the curvature radius 421 to the curvature radius 425 is a valid section, and the second groove 42 between the curvature radius 425 and the junction is an invalid section. Substantially, the invalid section can be omitted, such as enabling the curvature radius 421 to be directly connected with the first groove 32, or enabling the first groove 32 and the second groove 42 to be disconnected, but it currently has to act in concert with the two cables.

In specific, when the sliding member 2 slides from the first position towards the second position, since the curvature radius 321 of the first groove 32 is constant, a first torque (not shown) generated by gravity F1 (assuming that friction force is negligible) of the object 100 (referring to FIG. 1) and the sliding member 2 acting in concert with the curvature radius 321 as an effective moment arm with respect to the axle 3*a* as a pivot acting on the pulley 3 is a constant value. However, as the second end 54 of the elastic member 5 moves downwards and the elastic member 5 is being stretched, the elastic member 5 is elastically deformed, and thus a force F2 being correspondingly formed is gradually increased. Therefore, the gradually changing curvature radius of the second groove 42 (namely, the curvature radiuses 421-425 are gradually changing and are gradually decreasing as they surrounding the axle 3*a*), so as to enable a second torque (not shown) generated by the force F2 to be maintained as a constant value; and a sum of the first torque and the second torque is zero, so that the lifting device 1000 can be in a force equilibrium state, and the object 100 (referring to FIG. 1) can stay at any position.

Contrarily, when the sliding member 2 slides from the second position towards the first position, the second end 54 of the elastic member 5 moves upwards and the elastic member 5 is shrunk back, and the force F2 of the elastic member 5 gradually decreases while the curvature radiuses 421-425 are gradually increasing as they surrounding the axle 3*a*. Hence, during the period when the sliding member 2 slides from the second position towards the first position, the sum of the first torque and the second torque is zero, the lifting device 1000 still maintains the force equilibrium, and the object 100 can still stay at any position.

It is to be explained that, only five curvature radiuses 421-425 are being described in the present embodiment, but during the process when the sliding member 2 slides between the first position and the second position, the amount of curvature radiuses of the second groove 42 can be infinite.

Referring to FIG. 1 and FIG. 2, in the present embodiment, the lifting device 1000 further includes a turning pulley 7, disposed between the worm 4 and the elastic member 5, so as to change an extending direction of the connecting member 6. In specific, as shown in FIG. 4A, FIG. 5A and FIG. 6, the turning pulley 7 guides the connecting member 6, so that a portion of the connecting member 6 between the turning pulley 7 and the elastic member 5 is parallel to the lifting direction A1 (i.e., a gravitational direction), and thus avoids the elastic member 5 from producing different degrees of skewing due to being stretched by the connecting member 6. Namely, it prevents the skewing which causes the force F2 unable to be orthogonal to the corresponding curvature radius 421-425 of the second groove 42.

Referring to FIG. 2, in the present embodiment, the lifting device 1000 further includes a fine adjusting module 8, which is disposed on the body 1, wherein the connecting member 6 adjusts the extending direction of the connecting member 6 that passes through the fine adjusting module 8 by using the turning pulley 7. In specific, the fine adjusting module 8 includes a bolt 82, a position limiting member 84 and a fixed pulley 86. The bolt 82 is rotatably disposed on the body 1. The position limiting member 84 is disposed within the body 1 and screwed to the bolt 82. The fixed pulley 86 is pivoted to the position limiting member 84, and the second end portion 64 of the connecting member 6 is further connected to the sliding member 2 through the fixed pulley 86.

Figure 7A:
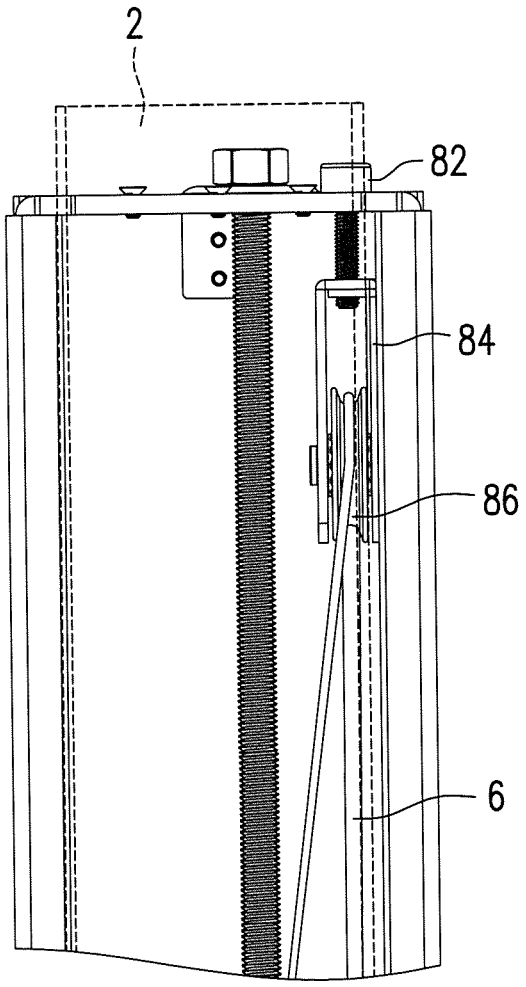
FIG. 7A to FIG. 7B are flow diagrams of the connecting member of FIG. 2 during a fine adjusting proccess.
Figure 7B:
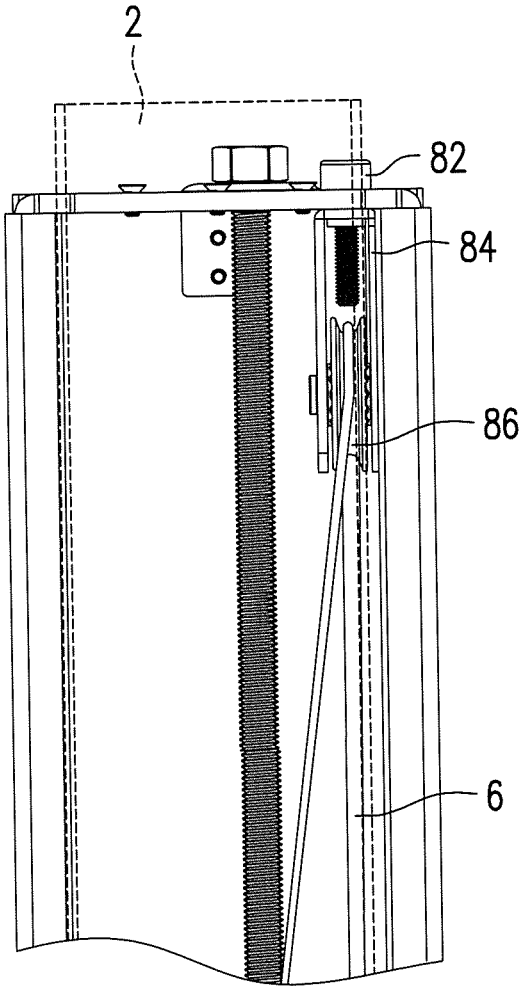

FIG. 7A to FIG. 7B are flow diagrams of the connecting member of FIG. 2 during a fine tuning process. Referring to FIG. 2 and FIG. 7A to FIG. 7B, when the bolt 82 rotates around the axle center thereof towards one direction, the position limiting member 84 moves in relative to the body 1 so as to drive the fixed pulley 86 to move upwards and to drive the fixed pulley 86 to rotate; and at this moment, the portion of the connecting member 6 between the fixed pulley 86 and the pulley 3 would move slightly upward or downward and drive the pulley 3 and the worm 4 to rotate, so as to confirm that, before starting the operation, a portion of the connecting member 6 extending from the worm 4 to the turning pulley 7 is exactly at a junction between the valid section and the invalid section, namely, at where the curvature radius 421 locates.

Figure 8:
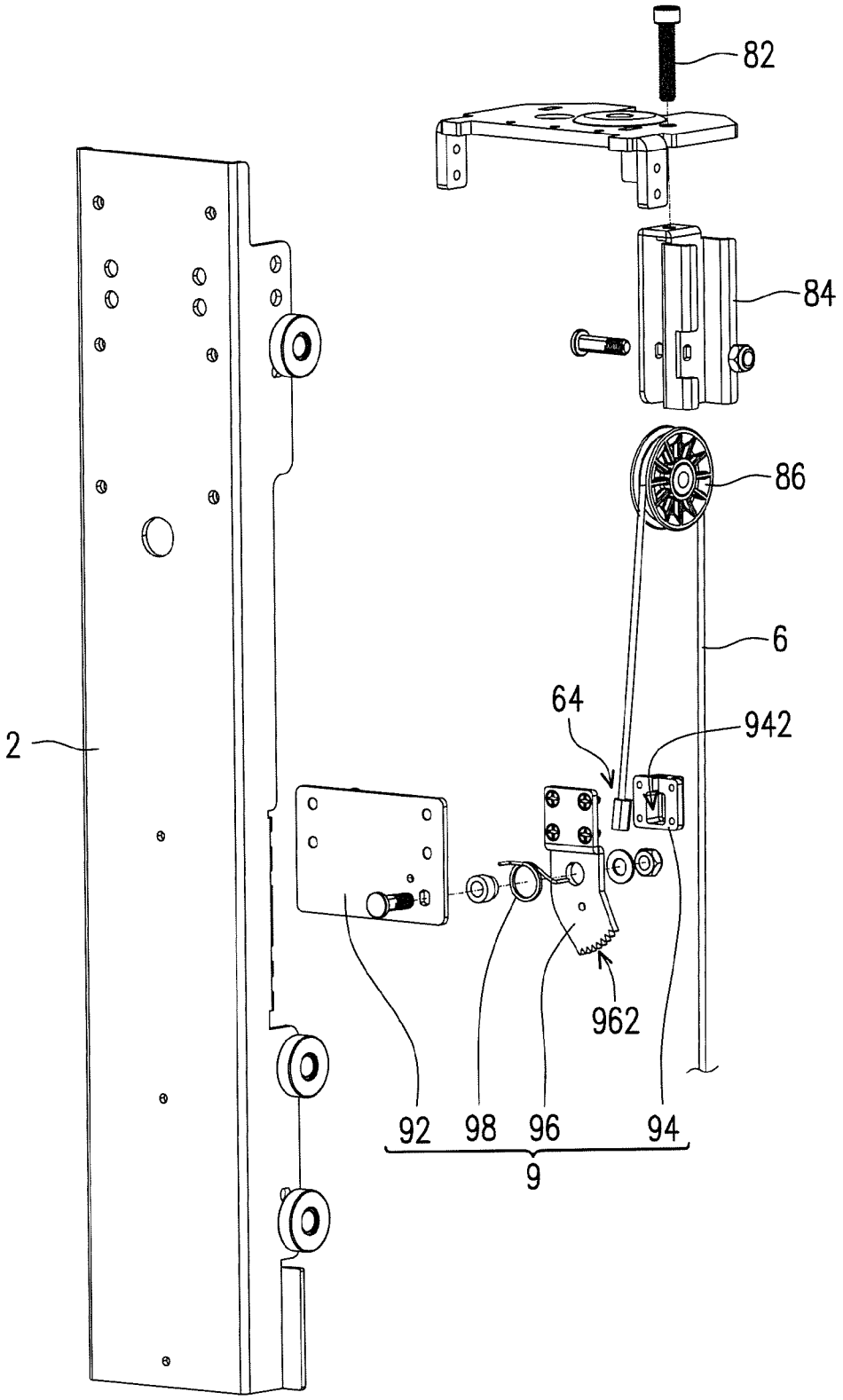
FIG. 8 is a partial exploded diagram of the lifting device of FIG. 2.

FIG. 8 is a partial exploded diagram of the lifting device of FIG. 2. Referring to FIG. 2 and FIG. 8, in the present embodiment, the lifting device 1000 further includes a stopper module 9, which is disposed within the body 1 and connected with the sliding member 2 and the second end portion 64 of the connecting member 6, wherein the stopper module 9 can move back-and-forth between the first position and the second position along with the sliding member 2. When the connecting member 6 breaks, the stopper module 9 is used to limit the sliding member 2 from sliding in the lifting direction A1 (referring to FIG. 4A), so as to prevent accidents. In specific, the stopper module 9 includes a fixed plate 92, a cover 94, a stopper plate 96 and a torsion spring 98. The fixed plate 92 is fixed on the sliding member 2 and can move back-and-forth along with the sliding member 2 in the lifting direction A1; the cover 94 is disposed at the fixed plate 92 and has an accommodating slot 942, the second end portion 64 of the connecting member 6 is accommodated in the accommodating slot 942; the stopper plate 96 is disposed between the fixed plate 92 and the cover 94, wherein the second end portion 64 of the connecting member 6 is sandwiched by the stopper plate 96 and the cover 94; an end of the stopper plate 96 has a zigzag structure 962; and the torsion spring 98 is disposed between the fixed plate 92 and the stopper plate 96, and two ends of the torsion spring 98 are respectively leaning against the fixed plate 92 and the stopper plate 96.

Figure 9:
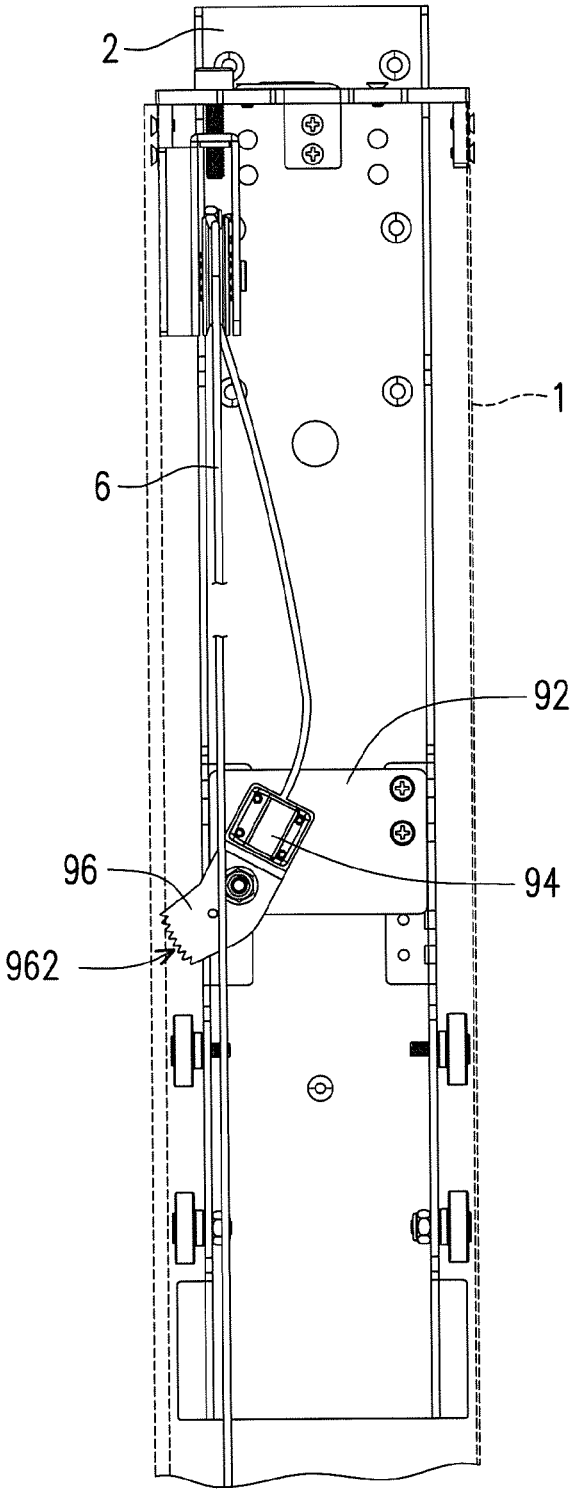
FIG. 9 is a schematic diagram illustrating the connecting member of FIG. 8 at a broken state.

FIG. 9 is a schematic diagram illustrating the connecting member of FIG. 8 at a broken state. Referring to FIG. 8 and FIG. 9, when the sliding member 2 slides and the connecting member 6 is not broken yet, a pulling force of the connecting member 6 conquers an elastic force of the torsion spring 98, and thus the stopper plate 96 does not rotate. In addition, when the sliding member 20 slides and the connecting member 6 suddenly breaks, since the pulling force of the connecting member 6 is gone, the elastic force of the torsion spring 98 drives the stopper plate 96 to rotate. Therefore, the zigzag structure 962 is embedded into the body 1, and the sliding member 2 immediately stops sliding. With the said configuration, during the period when adjusting the lifting position of the object 100 (referring to FIG. 1), and thus can avoid the risks of injuring the user due to sudden breaking of the connecting member 6 and sudden rising of the object 100.

Referring to FIG. 1 and FIG. 2, in order to correspond to different weights of the object 100 so that it can stay at any position between the first position and the second position, the lifting device 1000 of the present embodiment further includes a torque adjusting module 10, which is connected with the first end 52 of the elastic member 52. In specific, the torque adjusting module 10 includes a screw 12 and an adjusting portion 14. The screw 12 is rotatably disposed on the body 1. The adjusting portion 14 is disposed within the body 1 and screwed onto the screw 12, and the first end 52 of the elastic member 5 is hooked on the adjusting portion 14. When the screw 12 is being turned, the adjusting portion 14 rotates in relative to the screw 12 and moves back-and-forth along the lifting direction A1 (referring to FIG. 4A), so as to adjust a relative position of the first end 52 of the elastic member 5 at the body 1. In other words, before using the lifting device 1000, an initial length of the elastic member 5 can be adjusted by using the torque adjusting module 10, so as correspond to different weights of the object 100.

In summary, the pulley of the lifting device of the invention has the first groove surrounding the circumference thereof and the worm has the second groove surrounding the circumference thereof, wherein the connecting member is wound within the first groove and the second groove. When the sliding member slides between the two positions, the pulley and the worm can rotate at least one circle. As such, a total sliding stroke of the sliding member can be increased, so that the object can have a greater lifting distance. In addition, the curvature radius of the first groove of the pulley is a constant value, and the curvature radius of the second groove of worm is a non-constant values. When the sliding member slides from the first position towards the second position, or slides from the second position towards the first position, the sum of the first torque generated by the gravity of the object and the sliding member in concert with the curvature radius of the first groove and the second torque generated by the force of the elastic member in concert with the curvature radius of the second groove is zero, so that a force equilibrium state can be achieved. Thus, the sliding member can have an effect of staying at any position. Moreover, since the radius of the pulley is greater than the average radius of the worm, and the curvature radius of the pulley is greater than the average curvature radius of the worm, when the pulley and the worm rotate for one circle, the length of the portion of the connecting member being released is smaller than the length of the portion being wound. As such, the degree of stretching the elastic member is smaller than the total sliding stroke of the sliding member, so that the service life of the elastic member and the reliability of the lifting device are increased. In addition, the lifting device further includes the turning pulley for avoiding the elastic member from producing different degrees of skewing due to being stretched by the connecting member and thereby causing the force unable to be orthogonal to the corresponding curvature radius of the second groove. Furthermore, the lifting device can further include the fine adjusting module for confirming that the portion of the connecting member extending from the worm to the turning pulley is exactly at the junction between the valid section of the second groove and the invalid section of the second groove. As such, the extending direction of the connecting member is parallel to the lifting direction, so as to preventing the connecting member from skewing. In addition, the lifting device can further include the stopper module, which is used to limit the sliding member from sliding when the connecting member suddenly breaks. As such, the risks of injuring the user due to sudden breaking of the connecting member and sudden rising of the object can be avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lifting device, used to carry an object, the lifting device comprising:

a body;

a sliding member, slidably disposed on the body, used to carry the object, and capable of staying at any position between a first position and a second position;

a pulley, pivotally disposed within the body and having at least one first groove surrounding a circumference of the pulley, wherein a curvature radius of the first groove is a constant value;

a worm, being coaxial with the pulley, wherein the worm has a second groove surrounding a circumference of the worm, and a curvature radius of the second groove gradually changes;

an elastic member, disposed in the body and having a first end and a second end opposite to each other; and a connecting member, having a first end portion connected with the second end of the elastic member and a second end portion connected with the sliding member, and winding within the first groove and the second groove, wherein when the sliding member slides from the first position to the second position, or slides from the second position to the first position, the worm and the pulley rotate at least one circle, gravity of the object and the sliding member acts in concert with the curvature radius of the first groove to generate a first torque, elastic member is elastically deformed and correspondingly generates a force, the force acts in concert with the curvature radius of the second groove to generate a second torque, and a sum of the first torque and the second torque is zero.

2. The lifting device as recited in claim 1, wherein when the sliding member is located at the first position, a length of a portion of the connecting member winding within the first groove is greater than a length of a portion of the connecting member winding within the second groove, and when the sliding member is located at the second position, a length of a portion of the connecting member winding within the first groove is smaller than a length of a portion of the connecting member winding within the second groove.

3. The lifting device as recited in claim 2, wherein the curvature radius of the second groove gradually decreases from a junction between the first groove and the second groove.

4. The lifting device as recited in claim 3, further comprising a fine adjusting module disposed on the body, the fine adjusting module comprising:

a bolt, rotatably disposed on the body;

a position limiting member, disposed within the body and screwed to the bolt; and a fixed pulley, pivotally connected with the position limiting member, and the second end portion of the connecting member connected to the sliding member through the fixed pulley.

5. The lifting device as recited in claim 4, further comprising a turning pulley disposed between the worm and the elastic member for changing an extending direction of the connecting member.

6. The lifting device as recited in claim 1, further comprising a stopper module disposed within the body and connected with the sliding member and the second end portion of the connecting member, wherein the stopper module moves back-and-forth between the first position and second position along with the sliding member, and the stopper module comprises:

a fixed plate, fixed on the sliding member;

a cover, disposed on the fixed plate;

a stopper plate, disposed between the fixed plate and the cover, wherein the second end portion of the connecting member is sandwiched by the stopper plate and the cover, and an end of the stopper plate has a zigzag structure; and a torsion spring, two ends of the torsion spring respectively leaning against the fixed plate and the stopper plate, wherein when the connecting member breaks, the torsion spring drives the stopper plate to rotate, and the zigzag structure is embedded into the body to limit the movement of the sliding member.

7. The lifting device as recited in claim 1, further comprising a torque adjusting module, wherein the torque adjusting module comprises:

a screw, rotatably disposed on the body; and an adjusting portion, disposed within the body and screwed on the screw, and the first end of the elastic member being hooked on the adjusting portion, wherein when the screw rotates, the adjusting portion moves in relative to the elastic member along the screw so as to adjust a relative position of the first end of the elastic member at the body.

8. The lifting device as recited in claim 1, wherein the first groove and the second groove are not communicated with each other.

9. The lifting device as recited in claim 1, wherein the connecting member has two cables fixed at the first groove and the second groove.

10. The lifting device as recited in claim 1, wherein the pulley and the worm are integrally formed.

11. The lifting device as recited in claim 1, wherein the worm further has a position limiting slot, the connecting member further has a bump, the position limiting slot is disposed at the junction between the first groove and the second groove, and the bump is positionally limited within the position limiting slot.

* * * * *